United States Patent [19]

Nakagawa et al.

[11] 4,322,952

[45] Apr. 6, 1982

[54] REFRIGERATING APPARATUS

[75] Inventors: Noboru Nakagawa, Osaka; Toshiyuki Oonishi, Takatsuki; Masato Tsutsumi, Osaka; Akira Kawamoto, Takatsuki, all of Japan

[73] Assignee: Tokyo Shibaura Denki Kabushiki Kaisha, Kawasaki, Japan

[21] Appl. No.: 153,133

[22] Filed: May 27, 1980

[30] Foreign Application Priority Data

Aug. 8, 1979 [JP] Japan ..... 54-101089

[51] Int. Cl.[3] ..... F25B 41/00; F25B 39/02

[52] U.S. Cl. ..... 62/198; 62/504; 62/525; 417/208

[58] Field of Search ..... 62/149, 504, 198, 199, 62/525, 509; 417/52, 207, 208

[56] References Cited

U.S. PATENT DOCUMENTS

| | | | |
|---|---|---|---|
| 2,697,331 | 12/1954 | Zearfoss, Jr. | 417/208 X |
| 2,791,101 | 5/1957 | Zearfoss, Jr. | 62/4 |
| 3,238,737 | 3/1966 | Shrader et al. | 62/149 |
| 4,130,997 | 12/1978 | Hara et al. | 62/504 |

*Primary Examiner*—Henry C. Yuen
*Assistant Examiner*—Harry Tanner
*Attorney, Agent, or Firm*—Cushman, Darby & Cushman

[57] ABSTRACT

A refrigerating apparatus with at least two evaporators which are controlled at different temperatures by a refrigerant, a vapor bubble pump for pumping the refrigerant, a vapor bubble pump for pumping the refrigerant and a delayer located in the conduit path in which the refrigerant flows when said vapor bubble pump is not in operation for delaying the refrigerant flow therethrough.

5 Claims, 7 Drawing Figures

REFRIGERATING APPARATUS

This invention relates to a refrigerating apparatus, more particularly to an improvement in a refrigerating apparatus in which at least two evaporators are controlled to a different temperature.

Generally, a refrigerator having a freezing compartment and refrigerating compartment which are controlled to a different temperature has separate evaporators for the freezing compartment and for the refrigerating compartment because separate cooling is necessary for each compartment. The temperature of each compartment is controlled by a solenoid valve which is located in a conduit path connecting the freezing evaporator and the refrigerating evaporator for controlling refrigerant flow to one or both of the evaporators.

However, such solenoid valve has a mechanically movable valve which is buried in heat insulating material so that it is difficult to maintain or inspect the valve after the refrigerator is assembled. Accordingly, the life and the reliability of the refrigerator are not sufficient, and, moreover, this structure is too expensive.

Recently, a refrigerator which has a vapor bubble pump providing valve action to the refrigerant has been developed. However, this refrigerator has the drawback that the refrigerant flows into an auxiliary evaporator when the pump begins operation and this causes freezing in the refrigerator compartment.

It is an object of this invention to provide a refrigerating apparatus which can avoid the leakage of refrigerant flow into an auxiliary evaporator.

It is another object of the invention to provide a refrigerating apparatus which has a delayer for delaying a refrigerant flow.

It is a further object of the invention to provide a refrigerating apparatus which has a delayer for delaying a refrigerant flow to an evaporator when a vapor bubble pump is in operation.

In this invention, at least two evaporators are connected by a conduit through which flows a refrigerant, with a vapor bubble pump for pumping the refrigerant formed in one of the conduits. A delayer is located in the conduit in which the refrigerant flows when the vapor bubble pump not in operation for delaying the refrigerant flow therethrough.

DETAILED DESCRIPTION OF THE DRAWINGS

FIG. 3 shows that the vapor bubble pump not in operation.

FIG. 4 shows that vapor bubble pump in operation.

Figure 1:
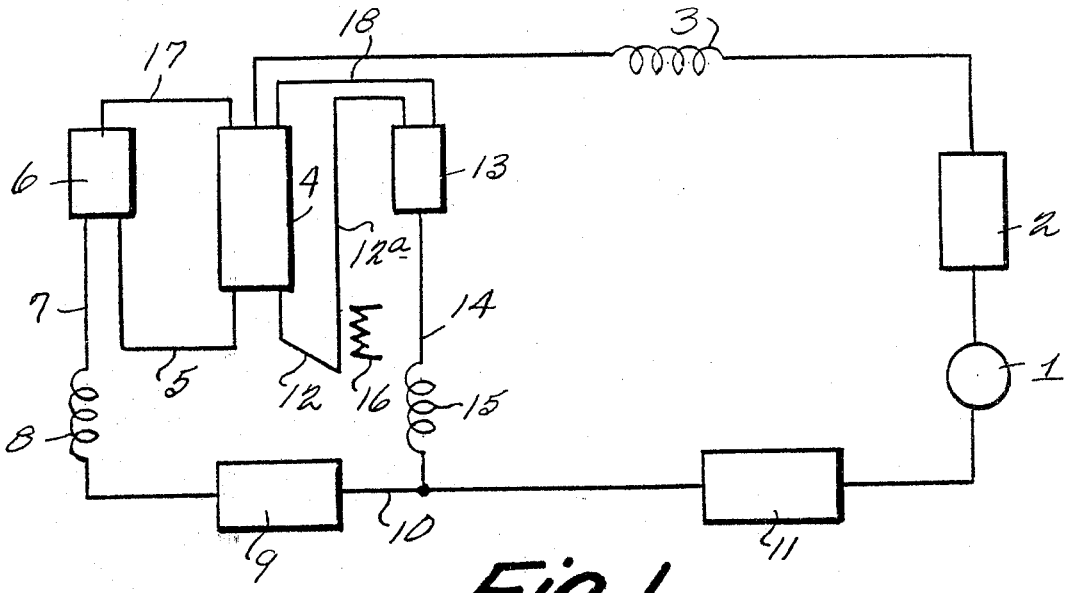
FIG. 1 is a schematic view of a refrigerating apparatus of this invention.
Figure 3:
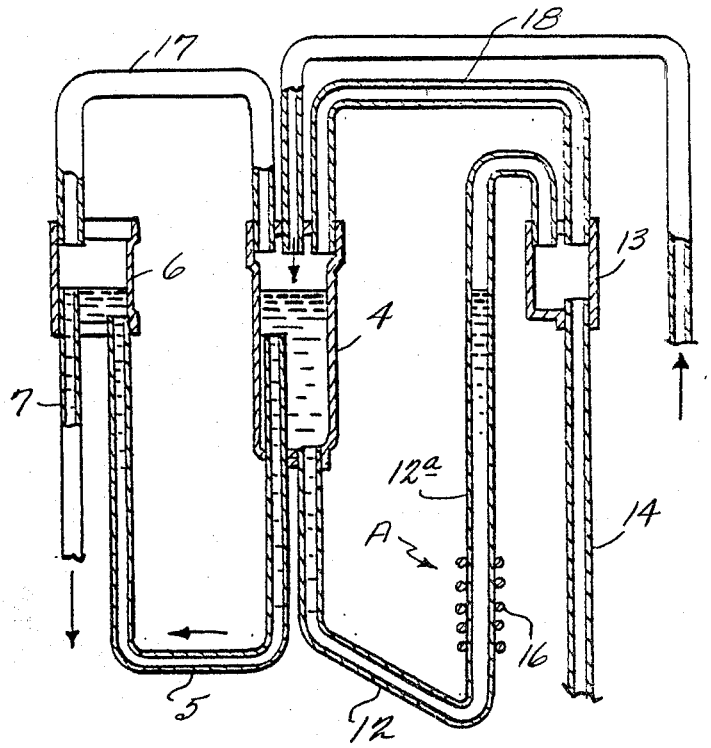
FIG. 3 and FIG. 4 are a construction of a vapor bubble pump of the invention.
Figure 4:
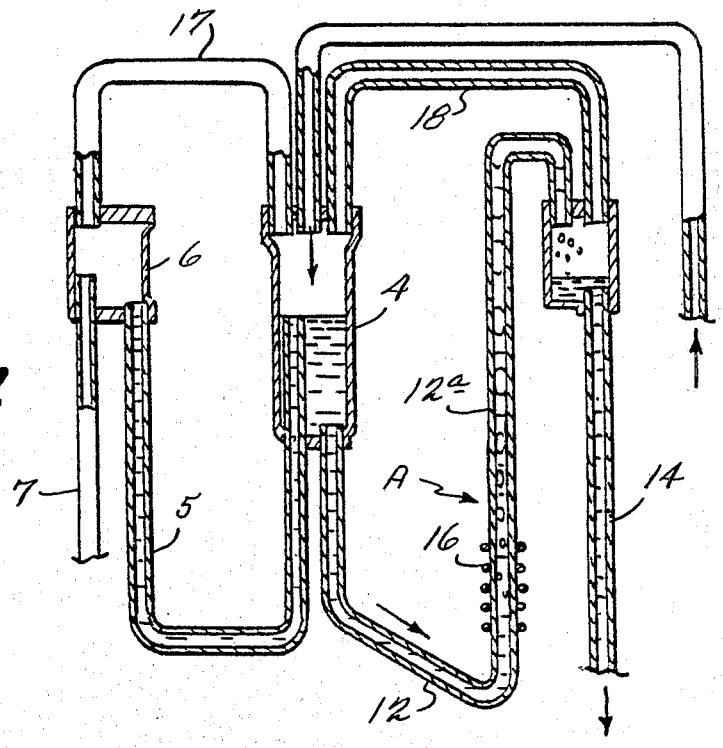

Referring to FIGS. 1, 3 and 4, high temperature gas of a refrigerant which is compressed by a compressor 1 is condensed by a condenser 2 and supplied to a liquid tank 4 through a pressure regulator such as a capillary tube 3. One end of a U-shaped conduit 5 is located in tank 4 and extends through the bottom of tank 4. The other end of conduit 5 is connected to the bottom opening of a delayer such as an accumulator 6. One end of a conduit 7 is located in accumulator 6 and extends through the bottom thereof. Conduit 7 is connected to a refrigerator evaporator 9 through a pressure regulator such as capillary tube 8. Refrigerator evaporator 9 is connected to a freezer evaporator 11 by a connecting conduit 10, and a freezer evaporator 11 is connected to compressor 1 to form a closed refrigerating cycle.

One end of another U-shaped conduit 12 is connected to the bottom opening of tank 4 and the other end of conduit 12 is connected to an opening in the top of a joint box 13 by bending downwardly. A rising portion 12*a* of conduit 12 extends higher than the top of conduit 7 which is connected to accumulator 6. One end of a conduit 14 is connected to the bottom opening of joint box 13 and the other end thereof is connected to connection conduit 10 through a pressure regulator such as a capillary tube 15. A heater is wound around the outer surface of a rising portion 12*a* of conduit 12. Rising portion 12*a* and heater 16 form a vapor bubble pump A. The inner pressure of tank 4, accumulator 6 and joint box 13 are equalized by conduits 17 and 18 which are connected between tank 4 and accumulator 6 and between tank 4 and joint box 13 respectively. Accumulator 6 is located between tank 4 and refrigerator evaporator 9 so that the refrigerant flows only when the vapor bubble pump A is not in operation. Then, when vapor bubble pump A begins its pumping action, accumulator 6 delays flow of the refrigerant into refrigerator evaporator 9 when vapor bubble pump A begins its pumping action.

Figure 2:
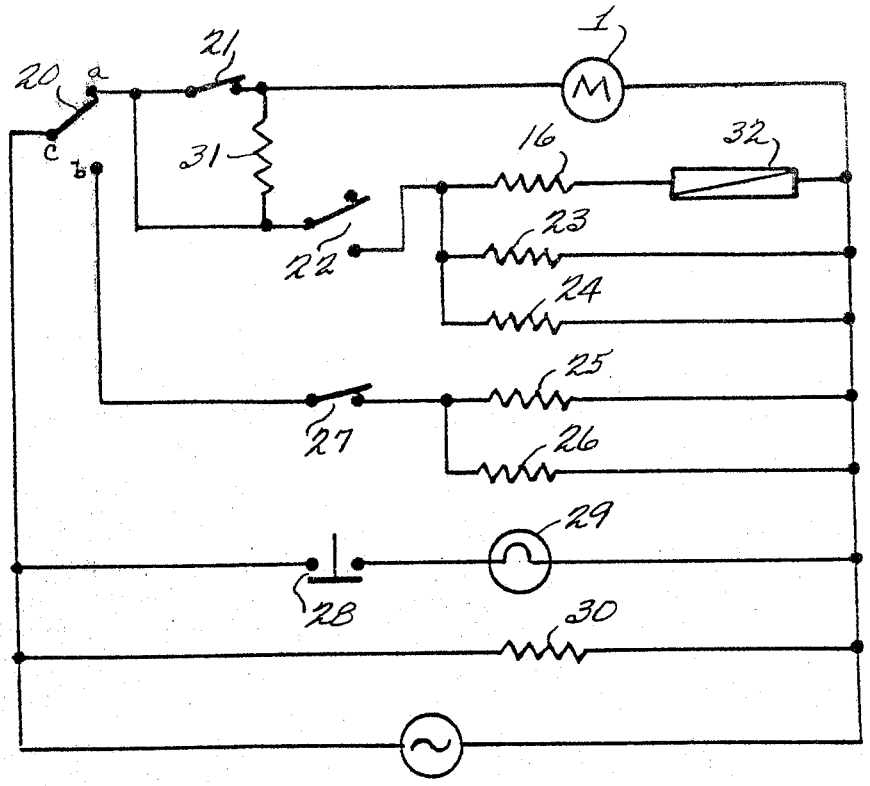
FIG. 2 is a wiring diagram of the invention.

FIG. 2 is a wiring diagram of this invention. The motor of compressor 1 is driven when the contact (a-c) of a defrost switch 20 is closed and a control switch 21 of the freezing compartment is closed. Heater 16 of vapor bubble pump A, a connect pipe heater 23 and a drain gutter heater 24 are energized when the temperature of the refrigerating compartment falls below a predetermined value and a control switch 22 of the refrigerating compartment is turned on. The motor of compressor 1 is stopped when the freezing compartment is cooled to a predetermined temperature and control switch 21 of the freezing compartment is turned off. The defrosting cycle, which is conventional, is attained by energizing a defrost heater 25 and a defrost sensor heater 26. A defrost bimetal switch 27 opens when the defrosting cycle is finished. A door switch 28 is closed when the door of the refrigerating compartment is opened and a lamp 29 which is located in the refrigerating compartment is turned on. A drain pipe heater 30 is located near the drain pipe of the freezing compartment, a heater 31 heats freezer control switch 21 and a fuse 32 is located in series with heater 16.

The operation of the invention will now be explained. When the temperature of the refrigerating compartment and freezing compartment are higher than a predetermined value, control switch 21 of the freezing compartment is kept closed and control switch 22 of the refrigerating compartment is kept open. Then the motor of compressor 1 is driven while heater 16 is kept deenergized. The refrigerant which is compressed by compressor 1 and condensed by condenser 2 is stored in liquid tank 4. The liquid refrigerant flows into accumulator 6 through U-shaped conduit 5 when the liquid level in tank 4 rises higher than the top of U-shaped conduit 5 in tank 4. The liquid refrigerant goes to refrigerator evaporator 9 and the freezer evaporator 11, through conduit 7 and capillary tube 8 so that the refrigerating compartment and the freezing compartment are cooled. In this condition, the liquid refrigerant does not flow into conduit 14 through U-shaped conduit 12 and joint box 13 because the inner pressure of tank 4, accumulator 6 and joint box 13 are kept equal by conduits 18 and 19 as the liquid level in tank 4, accumulator 6 and U-shaped conduit 12 are kept equal, and because rising portion 12*a* extends higher than the top of conduit 7 (see FIG. 3).

Heater 16 is energized when control switch 22 turns on so that the refrigerator compartment is cooled at the predetermined temperature. Vapor bubbles of liquid refrigerant in rising portion 12*a* are produced by heating rising portion 12*a* with heater 16. The liquid refrigerant is pumped up by the bubbles and overflows from the top of rising portion 12*a* into joint box 13 (see FIG. 4). Then, the liquid refrigerant flows into freezer evaporator 11 through conduit 14 and capillary tube 15, and cools the freezing compartment. At this time, the liquid level in tank 4 is reduced as the liquid refrigerant flows into freezing evaporator 11 through joint box 13. The cooling of the refrigerating compartment is interrupted when the flow of liquid refrigerant into refrigerator evaporator 9 is stopped. Since the temperature of the refrigerator compartment is lower than the predetermined temperature, compressor 1 is controlled in order to increase and decrease the temperature of the freezing compartment. When the temperature of the refrigerating compartment increases above the predetermined temperature, the action of vapor bubble pump A stops because control switch 22 is turned off. The liquid refrigerant then flows and cools through both the refrigerating and the freezing compartment via accumulator 6.

Figure 5:
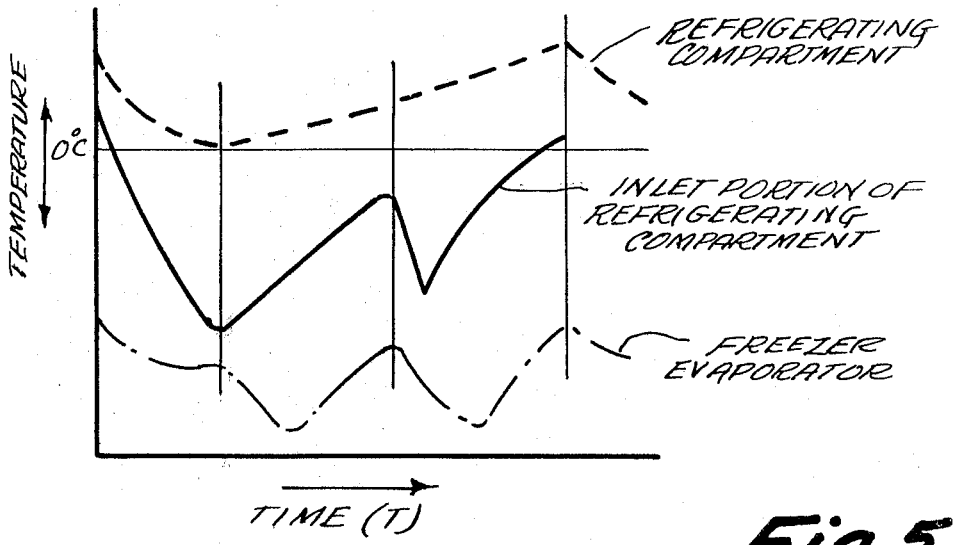
FIG. 5 is a diagram between time and a temperature of a refrigerating compartment and a freezing compartment.
Figure 6:
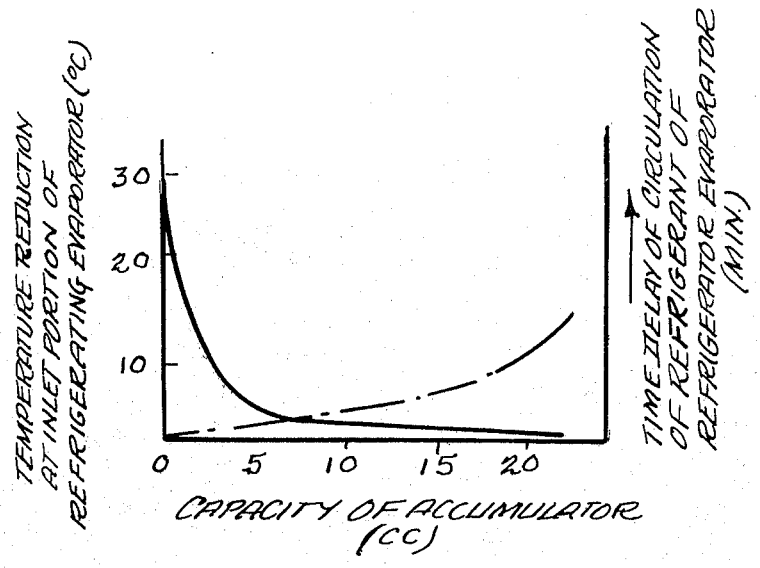
FIG. 6 is a diagram between the capacity of a accumulator and temperature reduction of the inlet portion of a refrigerator evaporator.

While vapor bubble pump A is in operation, if the refrigerant flows into the inlet portion of refrigerator evaporator 9, the inlet portion will be cooled. Especially, at the beginning of cooling only to freezer evaporator 11, the refrigerant temporarily flows into inlet portion of auxiliary refrigerating evaporator 9 over against the action of vapor bubble pump A because in spite of large refrigerant flow into tank 4, vapor bubble A cannot pump quickly enough. Then, as shown in FIG. 5, the temperature of the inlet portion of auxiliary refrigerator evaporator 9 temporarily falls at the time of the beginning of the action of freezer evaporator 11. Thus, the inlet portion of refrigerator evaporator 9 freezes and then vegetables and so on which are stored in the refrigerating compartment are frozen. In this invention, the refrigerant flows into refrigerator evaporator 9 via U-shaped conduit 5 and accumulator 6. Then, at the beginning of cooling only to freezer evaporator 11, the refrigerant does not flow into the inlet portion of auxiliary refrigerator evaporator 9 because the refrigerant flows via accumulator 6 and accumulator 6 has a capacity which delays flow at the beginning of operation of vapor bubble pump A. Moreover, the liquid level of tank 4 and accumulator 6 are kept equal because they are connected by conduit 17 therebetween. Thus, the refrigerant does not flow into refrigerator evaporator 9 when the liquid level of accumulator 6 abnormally rises during operation of vapor bubble pump A. As a result of experiment, a relation exists between the capacity of accumulator 6 and the temperature reduction of the inlet portion of refrigerator evaporator 9 or the time delay of the circulation of the refrigerant of refrigerator evaporator 9. As shown in FIG. 6, the refrigerant leaks to auxiliary refrigerant evaporator 9 if the capacity is small and the time delay of circulation to refrigerator evaporator 9 is large if the capacity is large. Thus, the capacity of accumulator 6 is selected between 5 cc to 20 cc.

Figure 7:
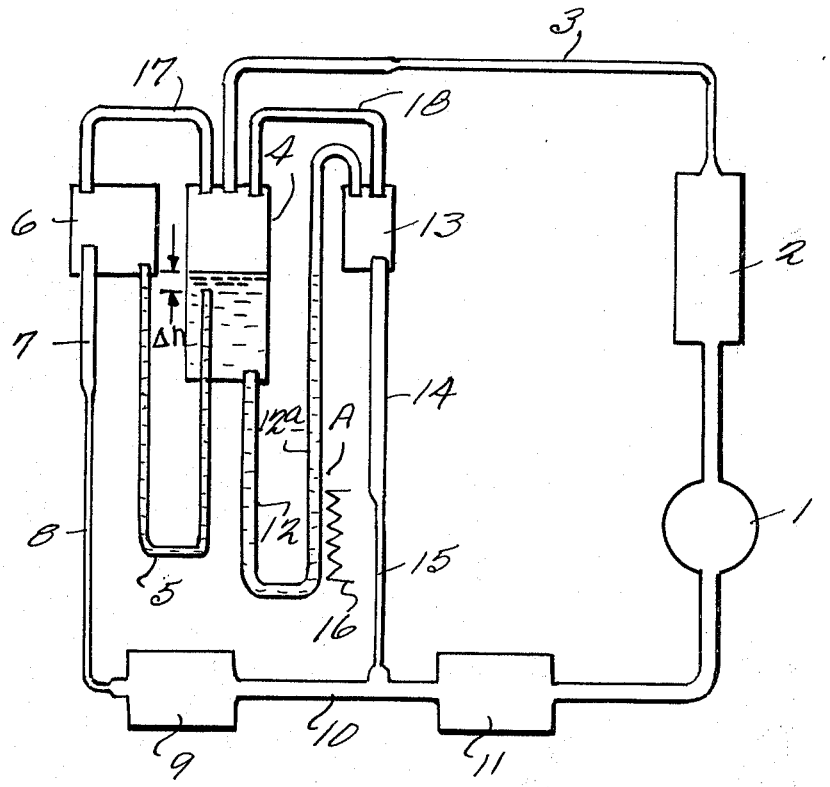
FIG. 7 is a schematic view of a refrigerating cycle of another embodiment of the invention.

FIG. 7 shows another embodiment of this invention. In this embodiment, the inner diameter of U-shaped conduit 5 is smaller than the inner diameter of U-shaped conduit 12 of vapor bubble pump A and conduit 17, so that the resistence of the refrigerant flow in U-shaped conduit 5 is larger than that of conduit 12 and conduit 17. Then, the refrigerant flow into accumulator 6 is delayed because the liquid level of U-shaped conduit 5 is kept for a while a little bit lower than that of conduit 12 (as shown "h" in FIG. 7) after the liquid flows into U-shaped conduit 5 and conduit 12. Thus, the unwanted refrigerant flow into auxiliary refrigerator evaporator 9 can be avoided during the beginning of operation of vapor bubble pump A. The refrigerant does not flow into refrigerating evaporator 9 if the inner diameter is extremely small. As a result of experiment, it is most effective that the inner diameter of U-shaped conduit 5 is 2 mm to 3 mm when the inner diameter of conduit 12 and conduit 17 are 4 mm to 9 mm but the refrigerant does not flow into refrigerator evaporator 9 when the inner diameter of U-shaped conduit 5 is smaller than 1.5 mm even if the inner diameter of conduit 12 and 17 are kept 4 mm to 9 mm.

In the above described embodiment, the refrigerant flows only to freezer evaporator 11 when vapor bubble pump A is acting, but it may be possible to flow the refrigerant to both freezer evaporator 11 and refrigerator evaporator 9 when vapor bubble pump A is acting if such is desired.

What is claimed is:

1. Refrigerating apparatus comprising:

a compressor for compressing a refrigerant, at least two evaporators which are controlled to a different temperature by evaporation of said refrigerant, a tank for storing said refrigerant, a plurality of conduits for conducting said refrigerant to said compressor, said evaporators and said tank, a vapor bubble pump for pumping said refrigerant and for controlling the flow of said refrigerant to one of said evaporators, and an accumulator which is located on the substantially same liquid level with said tank for delaying the flow of said refrigerant to the other of said evaporators when said vapor bubble pump begins pumping action thereof.

2. Apparatus as in claim 1, wherein said accumulator has a 5 cc to 20 cc in capacity.

3. Apparatus as in claim 1 or 2, further includes a conduit for equalizing the pressure of said tank and said accumulator.

4. Apparatus as in claim 1, wherein said one evaporator is for a freezer compartment and said the other evaporator is for a refrigerator compartment.

5. Refrigerating apparatus comprising:

a compressor for compressing a refrigerant, at least two evaporators which are controlled to a different temperature by evaporation of said refrigerant, a tank for storing said refrigerant, a plurality of conduits for conducting said refrigerant to said compressor, said evaporators and said tank, a vapor bubble pump for pumping said refrigerant and for controlling the flow of said refrigerant to one of said evaporator, and a conduit connecting said tank to the other of said evaporators having a larger resistance to flow than that of the conduit which conducts said refrigerant to said vapor bubble pump from said tank for delaying the flow of said refrigerant to the other of said evaporators when said vapor bubble pump begins pumping action thereof.

* * * * *